US007014377B2

(12) United States Patent
Yamauchi

(10) Patent No.: US 7,014,377 B2
(45) Date of Patent: Mar. 21, 2006

(54) KEY PAD, RESIN KEY TOP INJECTION MOLD, AND RESIN KEY TOP MANUFACTURING METHOD

(75) Inventor: Motoshi Yamauchi, Iwatsuki (JP)

(73) Assignee: Polymatech Co., Ltd., Tokyo (JP)

( * ) Notice: Subject to any disclaimer, the term of this patent is extended or adjusted under 35 U.S.C. 154(b) by 0 days.

(21) Appl. No.: 10/629,579

(22) Filed: Jul. 30, 2003

(65) Prior Publication Data

US 2004/0022573 A1 Feb. 5, 2004

(30) Foreign Application Priority Data

Aug. 2, 2002 (JP) ..... 2002-226675

(51) Int. Cl.
*B41J 5/08* (2006.01)
*B41J 5/10* (2006.01)

(52) U.S. Cl. ..... 400/472; 400/490; 264/328.1; 200/314; 362/24

(58) Field of Classification Search ..... 400/472; 235/145; 200/5; 264/328.1, 328.12; 425/812
See application file for complete search history.

(56) References Cited

U.S. PATENT DOCUMENTS 3,964,594 A * 6/1976 Gabbrielli et al. ..... 400/472
RE32,419 E * 5/1987 Rooney ..... 200/5
4,670,633 A 6/1987 Kaiwa et al.
5,574,446 A * 11/1996 Dittrich et al. ..... 341/22
6,437,972 B1 * 8/2002 Sellers ..... 361/680
6,765,503 B1 * 7/2004 Chan et al. ..... 341/22
2003/0116414 A1 * 6/2003 Maeda et al. ..... 200/56 R

FOREIGN PATENT DOCUMENTS

| | | |
|---|---|---|
| DE | 100 28 222 | 8/2001 |
| DK | 20117019 | 2/2002 |
| JP | 2001-245036 | 9/2001 |
| JP | 2002-052566 | 2/2002 |

OTHER PUBLICATIONS

Office Action, Sep. 27, 2004.
European Search Report.

* cited by examiner

*Primary Examiner*—Andrew H. Hirshfeld
*Assistant Examiner*—Marissa Ferguson

(74) *Attorney, Agent, or Firm*—Rader, Fishman & Grauer PLLC

(57) ABSTRACT

A key pad has resin key tops on a key sheet. The resin key tops have in their side surfaces clearance portions of a configuration in conformity with an outer configuration of interference members at least an upper portions of which are situated in displacement regions at bottom surface edges of the resin key tops allowing their displacement when they are depressed.

16 Claims, 8 Drawing Sheets

KEY PAD, RESIN KEY TOP INJECTION MOLD, AND RESIN KEY TOP MANUFACTURING METHOD

BACKGROUND OF THE INVENTION

1. Field of the Invention

This invention relates to a key pad suitable as a push-button switch component to be incorporated in the input portion of an electronic apparatus, such as a telephone, an audio apparatus, a television set, a VCR, a facsimile apparatus, a copying machine, or a vehicle-mounted apparatus, and, in particular, to a key pad, which is suitable as the push-button switch component of a portable apparatus of which a reduction in thickness and size is required. Further, this invention relates to a resin key top injection mold and a resin key top manufacturing method.

2. Related Background Art

Up to now, an illumination type key pad equipped with a translucent elastic key sheet and a translucent resin key top has been widely used as a push-button switch component to be incorporated in the input portion of a portable apparatus, such as a mobile phone. FIG. 12 shows a specific example of such a key pad. In the drawing, a key pad 1 is composed of a key sheet 2 obtained through molding of translucent silicone rubber or translucent thermoplastic elastomer into a sheet, and resin key tops 3 obtained through injection molding of a translucent thermoplastic resin into buttons and firmly attached to the key sheet 2 through the intermediation of translucent adhesive layers 4. This key pad 1 is placed on a substrate surface 7*a* having thereon disc springs 5, chip components 6 with LEDs or the like serving as the illumination sources, etc., and is integrated with a substrate 7, etc. to form a push-button switch for input operation.

In many cases, each resin key top 3 in such a push-button switch has at the outer periphery of the lower end of its side surface an outwardly protruding flange portion 8. This flange portion 8 is adapted to engage with the back surface of a casing 9 to prevent the key top from being detached from the apparatus (casing 9). Further, when the LEDs or the like incorporated in the chip components 6 are caused to emit light to illuminate the resin key tops from within the casing 9, leakage of light through the gaps between the resin key tops 3 and the casing 9 can be prevented by equipping the flange portions 8 with shielding layers, thereby enhancing the illumination property for the resin key tops 3.

Generally speaking, there is a requirement for a further reduction in the thickness and size of portable apparatuses, such as mobile phones. In view of this, in the key pad 1 as shown in FIG. 12, a further reduction in the thickness and size of the components including the key sheet 2, the resin key tops 3, and the adhesive layers 4 is being contemplated. However, a further reduction in the thickness and size of the key pad would result in a reduction in the interval between the resin key tops 3 facing each other and a reduction in the vertical distance between the resin key tops 3 and the substrate 7. Thus, it has been concluded that the flange portions 8 of the resin key tops 3 would inevitably come into contact with the chip components 6 protruding from the substrate surface 7*a*.

It might be possible to avoid this problem of contact, for example, by reducing the number of chip components 6. However, that would result in some of the resin key tops 3 not being sufficiently illuminated, making it impossible to uniformly and sufficiently illuminate all the resin key tops 3. It might also be possible to reduce the size of the resin key tops 3. However, that would involve a deterioration in the depression-operability of the resin key tops 3, resulting in a rather inaccurate input operation, which is inconvenient for the user.

In this regard, the present inventor considered a method of partially trimming the flange portions 8 of the resin key tops 3. However, as shown in FIG. 13, with the method in which the flange portions 8 are partially trimmed by a trimming die after the molding of the resin key tops 3, the cutting edges a through c are likely to involve positional variation, so that the width dimensions of the remaining flange portions 8 are rather varied, resulting in frequent occurrence of light leakage at the time of illumination. In particular, the resin key tops of a portable apparatus which is generally very small in total size are subject to such variation in the cutting edges a through c.

SUMMARY OF THE INVENTION

As described above, the present invention has been made after examining the way to avoid the problem of contact involved when the conventional key pad 1 is to be reduced in thickness and size. It is accordingly an object of the present invention to provide a key pad for use in a portable electronic apparatus or the like in which the resin key tops and the chip components such as LEDs do not come into contact with each other, which eliminates light leakage at the time of illumination, and in which the resin key tops are not easily detached from the apparatus.

Further, the present invention also aims to provide a resin key top for use in such a key pad, an injection mold for this resin key top, and a resin key top manufacturing method.

To achieve the above objects, there is provided, in accordance with the present invention, a key pad having resin key tops on a key sheet, in which the resin key tops have in their side surfaces clearance portions of a configuration in conformity with the outer configuration of interference members at least the upper portions of which are situated in displacement regions at bottom surface edges of the resin key tops allowing their displacement when they are depressed.

In accordance with this invention, the resin key tops have in their side surfaces clearance portions of a configuration in conformity with the outer configuration of interference members at least the upper portions of which are situated in displacement regions at the bottom surface edges of the resin key tops allowing their displacement when they are depressed, so that the resin key tops do not come into contact with the interference members whether the key tops are being depressed for input operation or not being depressed. Thus, it is possible to cope with the reduction in the distance between the side surfaces of the resin key tops and the reduction in the vertical distance between the resin key tops and the substrate due to the reduction in thickness and size. In particular, in the case of a key pad in which the resin key tops have on their side surfaces outwardly protruding flange portions with clearance portions formed therein, there is practically no fear of light being leaked through the gaps between the apparatus casing and the resin key tops when the back lights are on. Thus, such a resin key top with a clearance portion is capable of coping with a reduction in the thickness and size of the apparatus and is optimally applicable to an illumination type key pad and resin key tops used therein.

The above-mentioned interference member is the portion which would come into contact with the resin key top upon depression of the resin key to thereby hinder the descent of the resin key top were it not for the clearance portion in the resin key top. In many cases, it is composed of a "protrusion" from a general surface of a surface of the key sheet; in some cases, it maybe a leg portion or the like floatingly supporting the resin key top mounting portion of the key sheet so as to be capable of moving toward and away from the substrate surface opposed to the key sheet back surface. Further, the above-mentioned "protrusion" means an element protruding from the key sheet surface; it is a term covering both the key sheet itself and an object other than the key sheet. Specifically speaking, first, it means a circuit component connected to the substrate circuit in a protruding state with respect to the substrate surface opposed to the key sheet back surface. As stated above, the recent tendency toward a reduction in the thickness and size of portable apparatus is remarkable. However, there are limitations to a reduction in the thickness and size of the chip component such as LED, i.e., the circuit component itself, and a reduction in the vertical distance between it and the resin key top is inevitable. As a result, the circuit component has to protrude from a general surface of the key sheet surface through an insertion hole formed in the key sheet. In the present invention, however, it is possible, also in such a case, to avoid the above-mentioned contact due to the clearance portion of the resin key top. Further, the key sheet is often equipped with an "accommodating portion" for protecting such a circuit component. As a second specific example of what is implied by the term "protrusion", this "accommodating portion" is adopted. In some cases, regardless of whether the circuit component protrudes from the general surface of the key sheet or not, the accommodating portion is formed so as to protrude from the general surface. In particular, when the key sheet is to be perfectly waterproof and dust-proof, it protrudes from the general surface of the key sheet in a dome-like or box-like fashion to perfectly cover the circuit component. When such a waterproof and dust-proof property is not required, the accommodating portion is formed so as to protrude upwards in a cylindrical form from the sheet. Then, in the present invention, it is possible, in either case, to prevent the resin key top from coming into contact with the accommodating portion.

Further, this key pad is applicable to both of the following cases: the case in which, if there is no clearance portion, the side surface of the resin key top does not overlap the interference member when the key top is not being depressed for input, whereas when it is being depressed for input operation, the side surface of the resin key top overlaps the interference member, and the case in which the side surface of the resin key top overlaps the interference member whether it is being depressed or not. Thus, in either case, it is possible to prevent the resin key top from coming into contact with the interference member.

Further, the "clearance portion" of the resin key top may be of a configuration in which the wall thickness is entirely reduced along the height direction of the portion of the resin key top (e.g., the flange portion) where it is formed, or of a configuration in which the wall thickness is reduced only in the lower portion along the height direction thereof. Further, the term "conformity" does not imply that the configuration of the clearance portion perfectly coincides with the outer configuration of the interference member; it is only necessary for the resin key top to be capable of avoiding contact with the interference member, so that it suffices for their configurations to be substantially in conformity with each other. For example, when the outer configuration of the interference member is polygonal in section, the configuration of the clearance portion may be of an arcuate one with a radius of curvature somewhat larger than the circumscribed thereof.

Further, in accordance with the present invention, there is provided a resin key top injection mold having a key top forming portion in a resin key top molding cavity, in which the cavity is provided with a runner portion communicating with the key top forming portion, and in which there is further provided in the cavity a resin relief protrusion having a molding surface swollen from an entrance of the key top forming portion and the runner portion toward the key top forming portion, with the molding portion being smaller in width than the entrance and of a configuration in conformity with the outer configuration of the interference member at least the upper portion of which is situated in a displacement region of the bottom surface edge of the resin key top, which is to be displaced upon depression.

In this resin key top injection mold, the runner portion communicating with the key top forming portion is provided in the cavity. Further, in the cavity, there is provided the resin relief protrusion having a molding surface swollen from the entrance of the key top forming portion and the runner portion toward the key top forming portion, with the molding surface being smaller in width than the entrance and of a configuration in conformity with the outer configuration of the interference member at least the upper portion of which is situated in the displacement region of the bottom surface edge of the resin key top to be displaced upon a depressing operation. Thus, solely by the runner portion cutting off process, it is possible to easily form a clearance portion of a configuration in conformity with the outer configuration of the interference member, which is of, e.g., a V-shaped or arcuate configuration, on the resin key top and a part of the flange portion thereof. Further, since the resin relief protrusion is smaller in width than the entrance, it is possible for a molten resin to flow without allowing any air to be gathered on either side of the resin relief protrusion, making it possible to obtain a resin key top superior in dimensional performance and quality and a key pad using the same.

Further, this injection mold can be formed as one with pin holes allowing detachable attachment of a plurality of pin members constituting resin relief protrusions and differing in molding surface configuration. By thus forming pin holes allowing detachable attachment of a plurality of pin members differing in molding surface configuration, quick adaptation to a product with an interference member having a different outer surface configuration is possible solely by replacing the pin members without involving any remodeling of the mold itself, making it possible to obtain a resin key top injection mold superior in product compatibility.

Further, in a resin key top injection mold the entrance of which is wider on the key top forming portion side and narrower on the runner portion side, flow of a molten resin into the cavity takes place quickly, and it is possible to reduce or eliminate an occurrence of air gathering. Further, in a resin key top injection mold with an air vent portion communicating with a part of the runner portion, it is possible to eliminate any generation of flow marks on the resin key tops.

The present invention further provides a resin key top manufacturing method in which a molten resin is poured into a key top forming portion of a cavity formed in a resin key top injection mold and is allowed to solidify therein. More specifically, there is formed at least either an upstream side runner portion existing between a resin injection hole and a key top forming portion or a downstream side runner portion existing between the key top forming portion and an air vent portion, and a resin relief protrusion having a molding surface swollen from the entrance of the key top forming portion and the runner portion toward the key top forming portion, with the molding surface being narrower than the entrance and of a configuration in conformity with the outer configuration of an interference member at least upper portion of which is situated in a displacement region at the bottom surface edge of a resin key top to be displaced upon a depressing operation. Then, a process is executed in which a molten resin is poured into this cavity, allowed to solidify the rein, and released therefrom to thereby obtain a molded piece. Further, a process is executed in which a portion corresponding to the runner portion is removed from the molded piece, thereby providing a resin key top having on its side surface a clearance portion of a configuration in conformity with the outer configuration of an interference member at least the upper portion of which is situated in a displacement region of the bottom surface edge of the resin key top to be displaced upon a depressing operation.

In this resin key top manufacturing method, it is possible to easily form a clearance portion of a configuration in conformity with the outer configuration of the interference member on a part of the flange portion through a normally conducted runner portion eliminating process without adding any surplus step to the conventional resin key top manufacturing process. Further, since a molten resin is poured into the cavity of the injection mold having the runner portion and the resin relief protrusion, the clearance portion formed on the resin key top through molding can be reliably in a configuration in conformity with the outer configuration of the accommodating portion of the key sheet and no defective molding due to an occurrence of gathering of air or the like is involved. Further, generation of flow marks on the resin key top is prevented, and it is possible to obtain a high quality resin key top in which, even if an indicating portion having a character, symbol or the like thereon is provided on the back side of the resin key top, the indicating portion is not distorted by flow marks.

The above descriptions of this invention should not be construed restrictively. The objects, advantages, features, and uses of this invention will be made more apparent from the following description given with reference to the accompanying drawings. Further, it should be understood that all appropriate modifications not departing from the scope of the gist of this invention are covered by this invention.

BRIEF DESCRIPTION OF THE DRAWINGS

In the accompanying drawings:

FIG. 1 is a sectional view taken along the line 1—1 of

FIG. 2 is an enlarged plan view of a key pad according to an embodiment of the present invention, showing the portion 2 of FIG. 3;

DESCRIPTION OF THE PREFERRED EMBODIMENTS

Embodiments of the present invention will now be described in detail with reference to the drawings.

Figure 1:
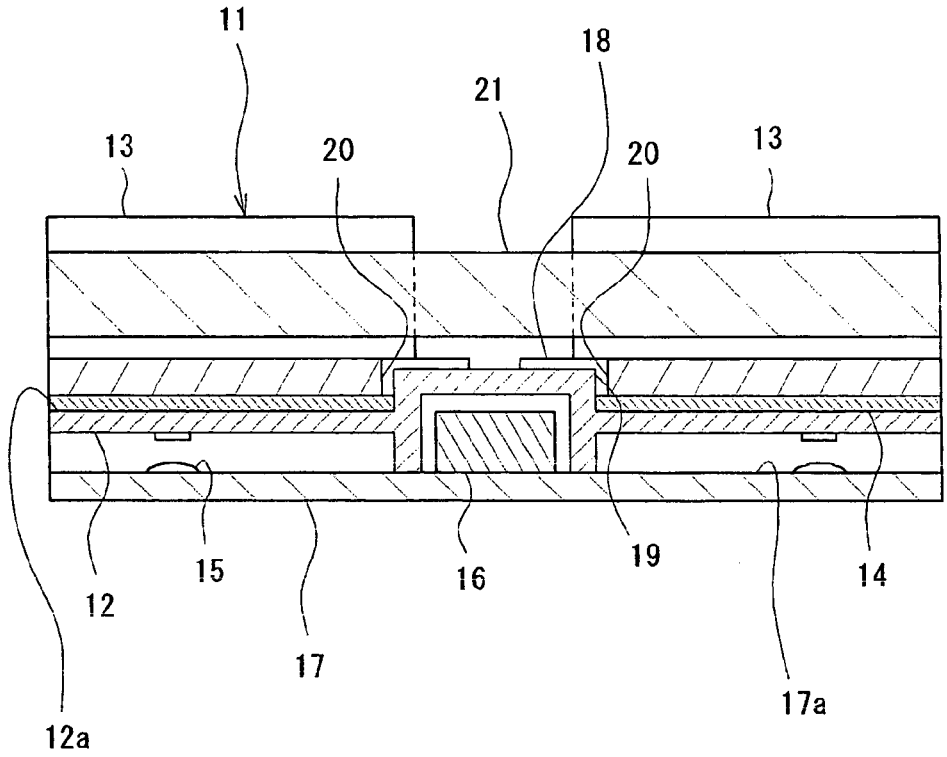
Figure 2:
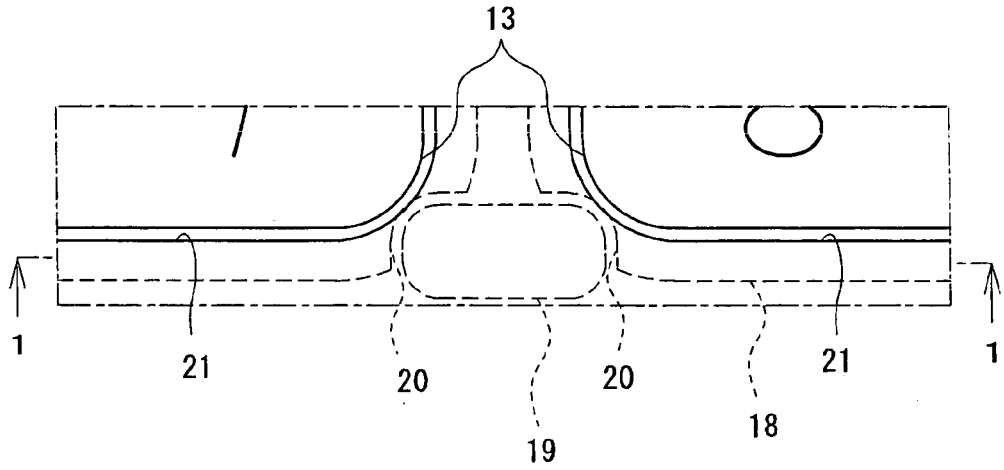
FIG. 2, showing a key pad according to an embodiment of the present invention.
Figure 3:
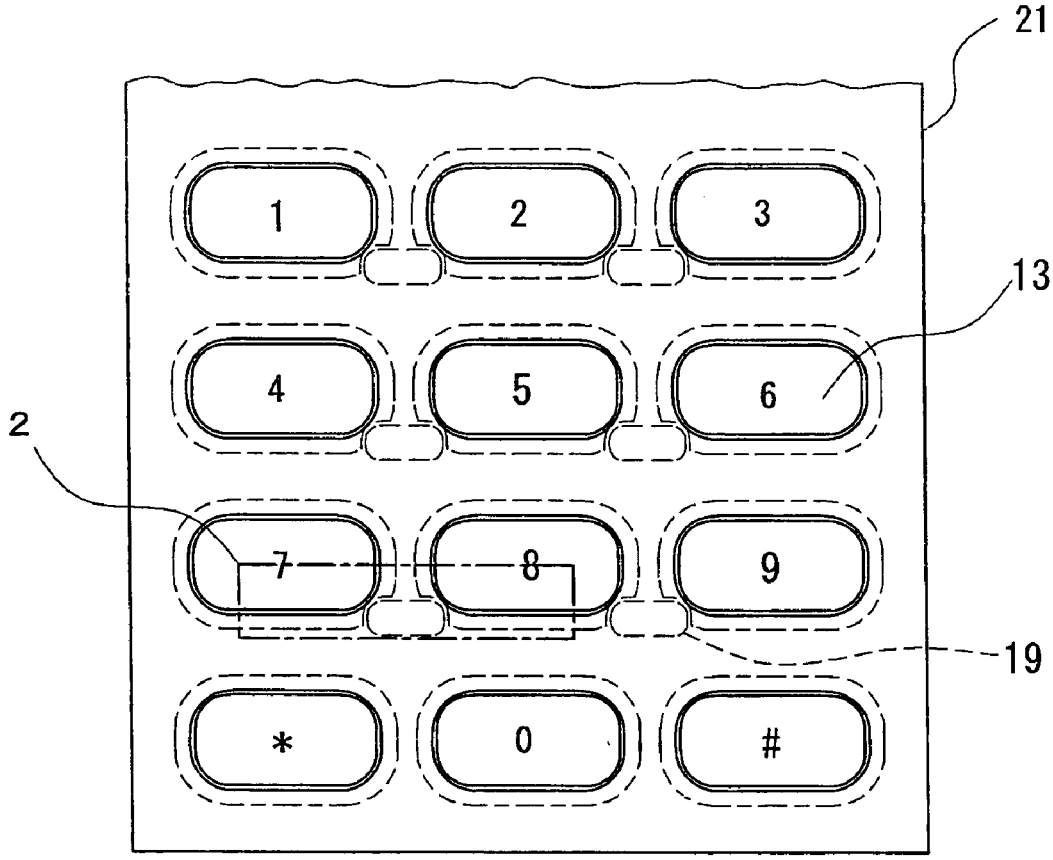
FIG. 3 is a partial enlarged plan view of the input portion of a mobile phone using a key pad according to an embodiment of the present invention.

A key pad 11 according to an embodiment of the present invention will be described with reference to FIGS. 1 through 3. FIG. 2 is a partial enlarged view of a portion 2 of a key pad to be used in a mobile phone as shown in FIG. 3, and FIG. 1 is a sectional view taken along the line 1—1 of FIG. 2. As shown in FIG. 1, the key pad 11 of this embodiment has a flexible key sheet 12 formed of translucent silicone rubber, thermoplastic elastomer, or the like, and resin key tops 13 obtained by molding translucent thermoplastic resin and fixed to the key sheet through the intermediation of a translucent adhesive layer 14. Then, the key pad 11 is placed on a substrate 17 having contact switches 15 and a chip component 16 consisting of an LED or the like serving as the illumination source. The resin key tops 13 and the circuit (not shown) on the substrate 17 are reduced in thickness and size as compared with those in the prior art, and the chip component 16 containing a component such as an LED in the form of a package that cannot be directly incorporated in the substrate circuit protrudes from the substrate surface 17*a* and is connected to the substrate circuit. Thus, formed in the key sheet 12, formed so as to cover the substrate 17, is an accommodating portion 19 in the form of a box covering the chip component 16 and protruding from a general surface 12*a* constituting the surface of the key sheet 12, with the accommodating portion 19 constituting an "interference member" (or "protruding member"). Further, the distance between the resin key tops 13 is reduced as compared with that in the prior art, so that clearance portions 20 of a configuration in conformity with the outer configuration of the accommodating portion 19 and keeping them out of contact therewith are formed on flange portions 18 serving as the "side surfaces" of the resin key tops 13 opposed to the accommodating portion 19 serving as the "interference member" (or the "protruding member"). In other words, the flange portions 18 have the clearance portions 20 of a configuration in conformity with the outer configuration of the accommodating portion 19. Thus, in this embodiment, if the clearance portions 20 were not provided, the flange portions 18 serving as the "side surfaces" of the resin key tops 13 and the accommodating portion 19 would overlap each other in the height direction when no depressing operation for input is being performed.

Figure 4:
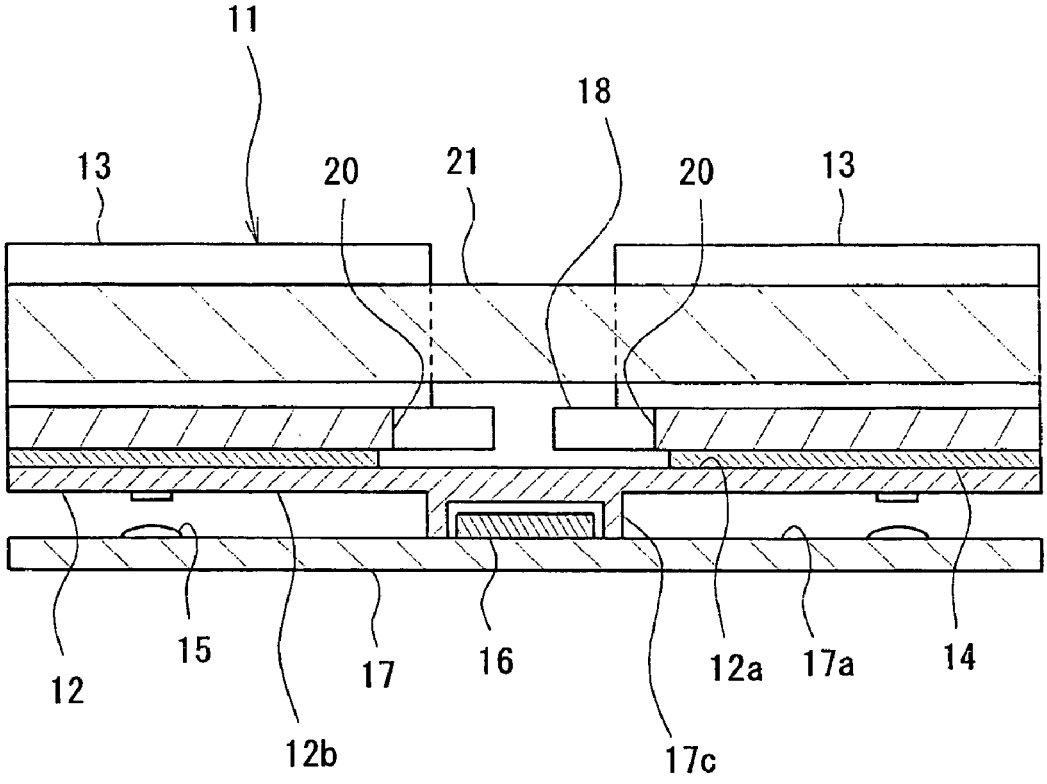
FIG. 4 is a sectional view of a key pad according to another embodiment of the present invention.

While in this embodiment the accommodating portion 19 is formed based on the size of the chip component 16, it is also possible to form the accommodating portion 19 based on the sizes of the various elements, components, wiring, etc. other than the chip component 16. It is also possible for the accommodating portion 19 to be formed as a cylinder with its upper end open or in a "leg-less" configuration in which the portion thereof extending downwards from the back surface of the key sheet 12 to the substrate surface 17*a* is omitted. Further, when the chip component 16 is high enough to extend beyond the general surface 12*a* of the key sheet 12, it is possible to form an insertion hole in the key sheet 12, with the high chip component protruding therefrom. In this case, the chip component constitutes the "protruding member". Further, as shown in FIG. 4, it is also possible to adopt a construction in which the general surface 12*a* of the key sheet 12 is flat and in which the accommodating portion covering the chip component 16 consists of a leg portion 17*c* floatingly supporting the portions of the key sheet 12 mounted to the resin key tops 13 such that they can move toward and away from the substrate surface 17*a* opposed to the key sheet back surface 12*b*. In this case, the leg portion 17*c* constitutes the interference member.

The resin key tops 13 of this embodiment are preferably formed of a translucent resin which allows light to be transmitted there through. Examples of the resin for the resin key tops 13 include polycarbonate resin, polymethyl methacrylate (PMMA) resin, polystyrene (PS) resin, acrylonitrile-styrene (AS) copolymer, methylmethacrylate-styrene (MS) copolymer, and polyethylene (PE) type resin. From the viewpoint of translucency, wear resistance, etc., polycarbonate resin is preferable. Note that in this specification the term "translucent" refers to a visible light transmission of 0.1% or more. When the visible light transmission is 0.1% or more, the surface of the resin key top 13 is perceived as illuminated when the back light consisting of an LED or the like is lighted.

The key sheet 12 of this embodiment is preferably formed of silicone rubber, which is a translucent and flexible rubber-like elastic material, thermoplastic elastomer, or the like. For, the key sheet 12 must be as follows: when the resin key top 13 is depressed, it is deflected to turn ON the contact switch 15, whereas, when the depression is canceled, it is restored to the initial position. Further, the reason for adopting a translucent rubber-like elastic material is that, in the case of the illumination type key pad 11, it is necessary for light to be transmitted through the key sheet 12.

The adhesive layer 14 of this embodiment consists of a translucent adhesive which is capable of gluing the resin key tops 13 and the key sheet 12 to each other. More specifically, it is an adhesive of cold setting type, ultraviolet setting type, etc. It is possible to adopt various types of adhesive including urethane type and acrylic type ones. The adhesive layer 14 prevents the resin key tops 13 from falling out of the casing 21. The flange portions 18 of the resin key tops 13 are engaged with the casing 21, so that, in some cases, the resin key tops 13 need not be glued to the key sheet 12.

Regarding the chip component 16 having an illumination source such as an LED with light emitting function, the substrate 17, etc., they may consist of ordinary members for use in the push-button switch of a portable apparatus or the like.

Next, a method of manufacturing the resin key tops 13 according to an embodiment of the present invention will be described.

First, a mold for injection molding of molten resin is prepared. This mold is composed of first and second molds.

Figure 5:
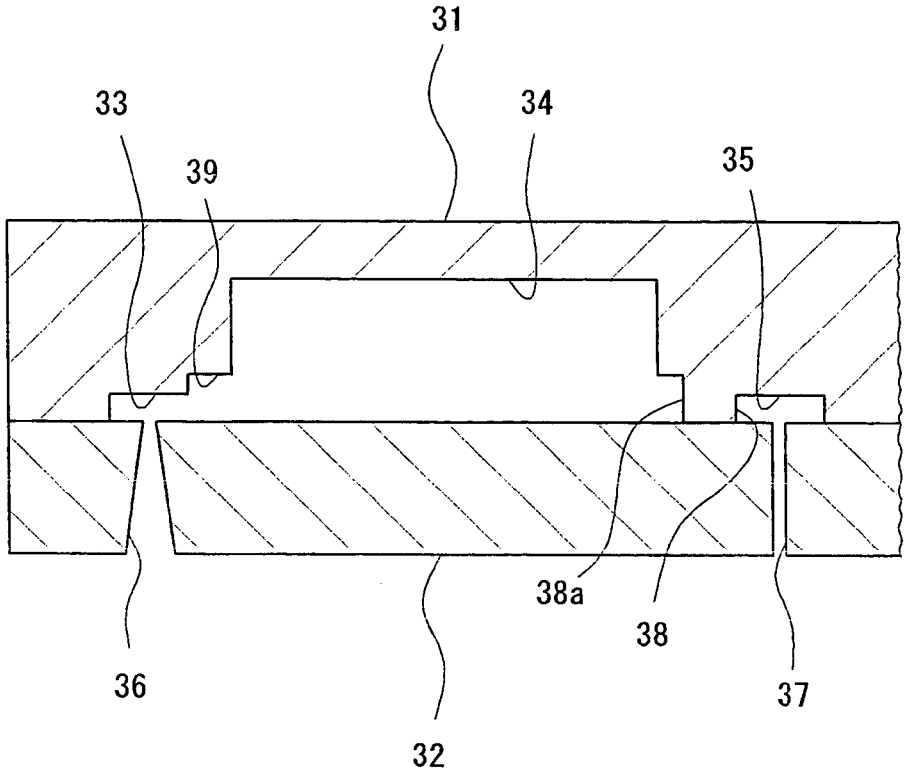
FIG. 5 is a sectional view taken along the line 5—5 of FIG. 6, showing a main parts of a resin key top injection mold according to an embodiment of the present invention.
Figure 6:
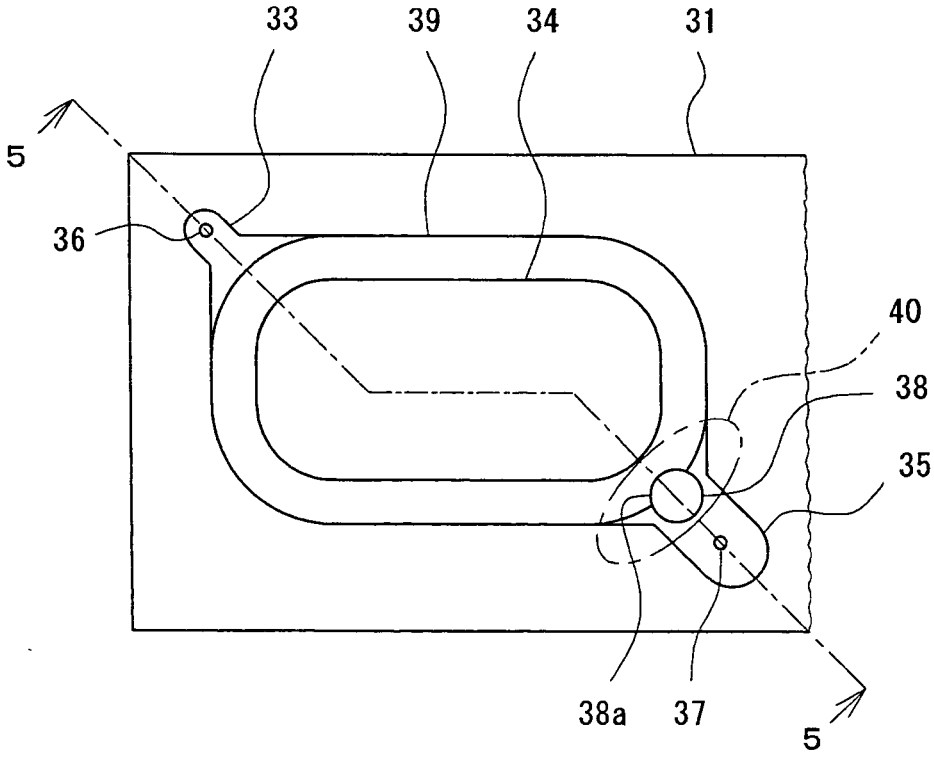
FIG. 6 is a transparent plan view of a main parts of a resin key top injection mold according to an embodiment of the present invention.

As shown in FIGS. 5 and 6, the first mold 31 is the mold for molding the front side of the resin key top 13. It has a recess which defines a cavity composed of a first runner portion 33, a key top forming portion 34, and a second runner portion 35 when the first mold 31 is mated with the second mold 32.

The first runner portion 31 communicates with a resin injection hole 36 provided in the second mold 32, and constitutes the "upstream side runner portion" serving as a flow passage for molten resin leading to the key top forming portion 34. The key top forming portion 34 is the portion which gives the resin key top 13 after the releasing and the cutting off of unnecessary portions, and which includes a flange portion 39.

The second runner portion 35 is the portion which collects overflowing resin so that molten resin may sufficiently fill the key top forming portion 34, and which constitutes the "downstream side runner portion" communicating with an air vent portion 37 formed in the second mold 32. The second runner portion 35 is diagonally formed with respect to the first runner portion 33 with the key top forming portion 34 being therebetween. Further, in the entrance (boundary) 40 of the key top forming portion 34 (inclusive of the flange portion 39) and the second runner portion 35, there is formed, substantially at the center thereof, a resin relief protrusion 38 protruding from the cavity surface of the first mold 31 to the surface of the second mold 32, with the resin relief protrusion being in the form of a cylinder vertically extending inside the cavity. This resin relief protrusion 38 has a molding surface 38*a* expanded at the entrance 40 toward the key top forming portion 34 (39) side and narrower than the entrance 40. Further, it has a configuration such that it is in conformity with the outer configuration of the accommodating portion 19 of the key sheet 12 opposed to the molded resin key top 13. That is, a part of the cross-sectional configuration of the resin relief protrusion is in conformity with the outer configuration of the accommodating portion 19 serving as the "interference member". Further, the entrance 40 is formed so as to be wider on the key top forming portion 34 side and narrower on the second runner portion 35 side.

As shown in FIG. 5, the second mold 32 is the mold for molding the back side of the resin key top 13, and is equipped with the resin injection hole 36 serving as the gate for supplying molten resin to the first runner portion 33 and the air vent portion 37 for effecting air venting from the second runner portion 35, with the cavity surface being formed as a flat surface.

Figure 7:
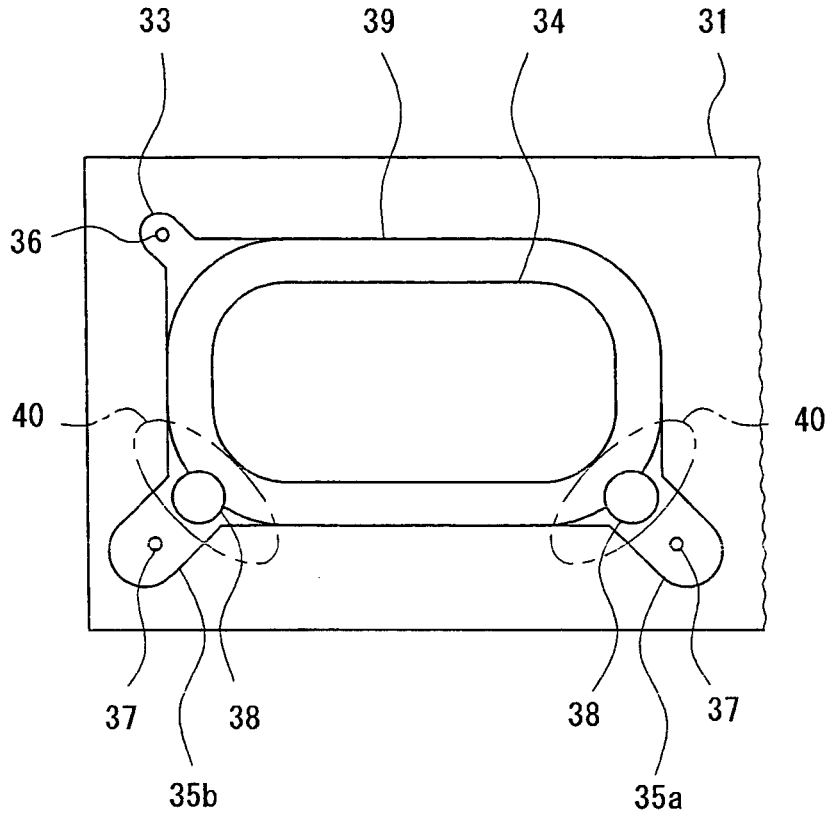
FIG. 7 is a transparent plan view of a main parts of a resin key top injection mold according to another embodiment of the present invention.

The first mold 31 and the second mold 32 of this embodiment are as described above. As shown in FIG. 7, in addition to the second runner portion 35*a* provided diagonally with respect to the first runner portion 33, it is also possible to provide another second runner portion 35*b* in a corner adjacent to the first runner portion 33. This type of mold is used, for example, when manufacturing the resin key top 13 marked with the number "8" as shown in FIG. 3. Further, when forming a key pad in which the interference member faces not a corner but a side surface of the resin key top, it is possible to provide the runner portion not in a corner but on a side portion of the resin key top (not shown).

Figure 8:
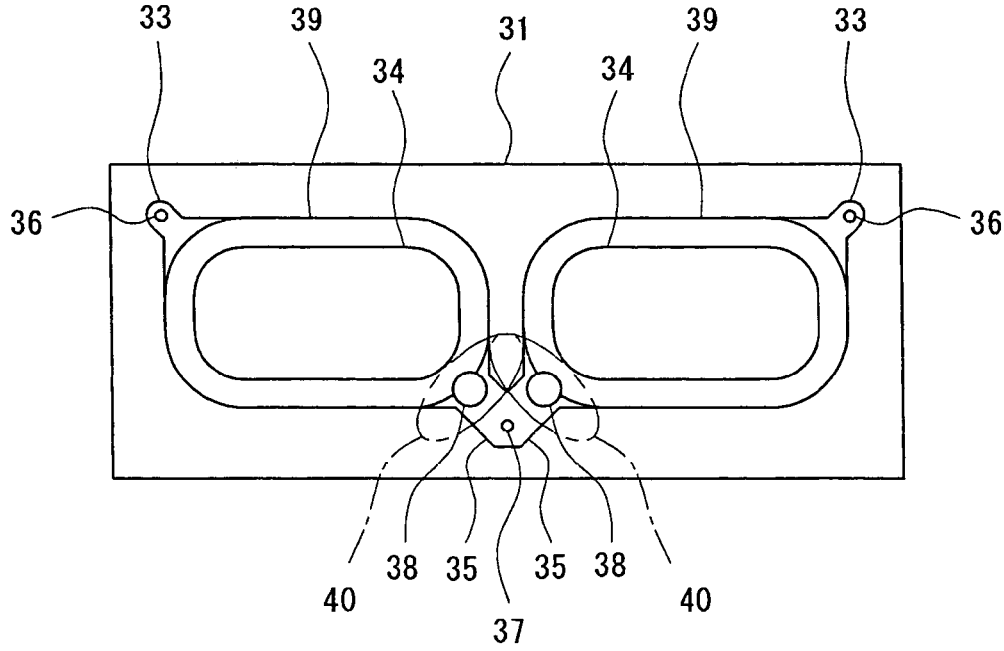
FIG. 8 is a transparent plan view of a resin key top injection mold according to another embodiment of the present invention.
Figure 9:
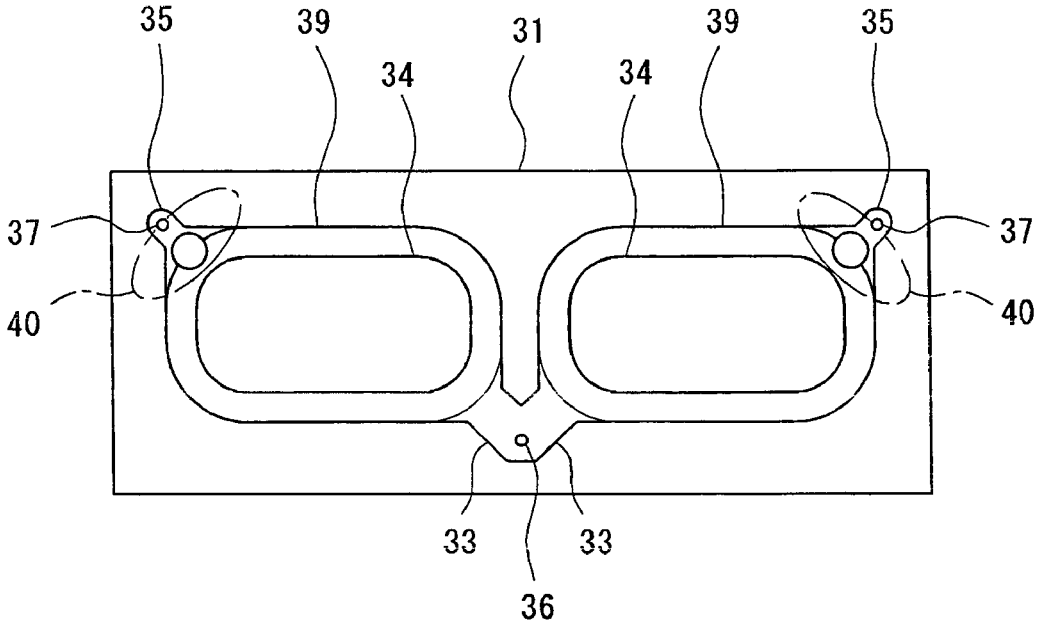
FIG. 9 is a transparent plan view of a resin key top injection mold according to another embodiment of the present invention.

Further, as shown in FIG. 8, by slightly modifying the configuration of the second runner portion, it is possible to form molded pieces constituting two key tops 13 by means of a mold 31 with cavities arranged symmetrically in the horizontal direction. Further, it is also possible to modify the mold 31 of FIG. 8 into one which is also symmetrical in the vertical direction to realize a four-piece mold (not shown) in which four cavities are arranged around the common air vent portion 37. Further, as shown in FIG. 9, it is also possible to realize a mold in which a common first runner portion 33 is provided for two key top forming portions 34 and in which molten resin flows into the two key top forming portions 34 through the single resin injection hole 36. With this mold, it is possible to reduce the number of resin injection holes 36 with respect to the resin key tops 13 to be obtained, thereby facilitating and expediting the resin pouring operation and reducing the amount of resin accumulated in the first runner portion 33 to be disposed of.

The configurations of the first runner portion 33 and the second runner portion 35 are not restricted to those shown in the drawings described above. It is also possible to partially equip the first runner portion 33 and the second runner portion 35 with recesses in the form of liquid reservoirs or the like into which resin flows. Further, it is also possible to form the resin relief protrusion 38 on the first runner portion 33 side instead of on the second runner portion 35 side.

Figure 10:
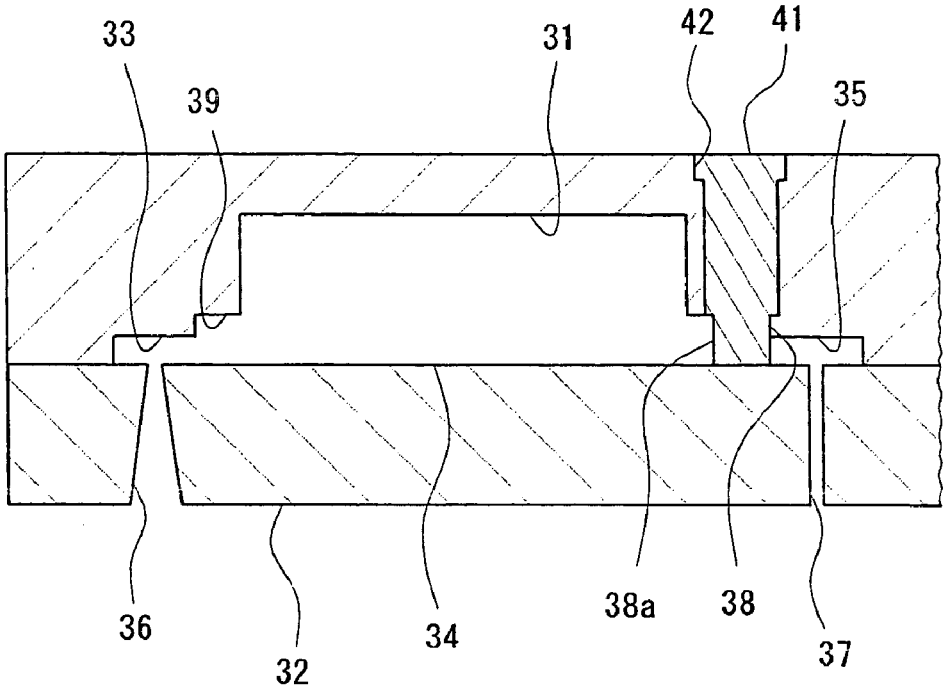
FIG. 10 is a longitudinal sectional view of a resin key top injection mold according to another embodiment of the present invention.

Further, while in the above embodiment the resin relief protrusion 38 is formed in the first mold 31 itself, it is also possible to prepare a molding pin 41 serving as the "pin member" having a molding surface corresponding to the sectional configuration and size of the clearance portion 20 so that the clearance portion 20 can be easily formed in correspondence with changes in configuration and size due to use of a different chip component 16, and to form in the first mold a pin insertion hole 42 allowing attachment of the molding pin 41 as shown in FIG. 10, forming the resin relief protrusion 38 by fitting this molding pin 41 into the first mold. The material of this molding pin 41 preferably consists of a hardened iron material or the like.

When using the first mold 31 and the second mold 32 as described above, the molds 31 and 32 are mated with each other, and then molten resin is poured through the resin injection hole 36. The injected molten resin flows from the first runner portion 33 to the key top forming portion 34 including the flange portion 39, and then to the second runner portion 35. At this time, there protrudes from the cavity surface of the first mold 31 in a column-like fashion the resin relief protrusion 38 so as to extend through the entrance 40 of the key top forming portion 34 and the second runner portion 35 to about the second mold 32, exhibiting a molding surface expanding toward the key top forming portion 34 side, being narrower than the entrance and of a configuration in conformity with the outer configuration of the key sheet accommodating portion 19, so that molten resin flows on both sides of the resin relief protrusion 38 through the entrance 40 to flow into the second runner portion 35. Thus, there is no fear of air being gathered so as to generate an irregularly shaped portion in the molded piece, making it possible to fill the cavity evenly with molten resin. When the filling of the cavity with molten resin has been completed, the injection of molten resin is stopped, and the mold is cooled to solidify the molten resin. Thereafter, releasing is performed, whereby a molded piece is obtained in which the portion corresponding to the resin relief protrusion 38 constitutes a substantially disc-like cutout with a substantially semi-circular portion of a configuration in conformity with the outer configuration of the key sheet accommodating portion 19.

The portions corresponding to the first runner portion 33 and the second runner portion 35 are removed from this molded piece by using a cutting die, whereby the resin key top 13 having the clearance portion 20 in the flange portion 18 thereof is obtained.

The obtained resin key top 13 is joined to the key sheet 12 by adhesive, whereby the key pad 11 is obtained.

As another manufacturing method, instead of pouring molten resin directly into the molds 31 and 32, a resin film (not shown) may be provided on the first mold 31 side before pouring the molten resin. By using this method, a key top which has a resin film layer on the resin key top surface is obtained.

Here, examples which are different from the above embodiments of the present invention will also be described. For example, as in the case of an injection mold 43 as shown in cross section in FIG. 11, a swollen portion 45 is simply formed in order that the flange portion 44 of the resin key top can be removed beforehand to form the clearance portion 20 as in the above embodiment. As a result, it is rather hard for molten resin to flow through that portion, and air is gathered at a number of places around the swollen portion 45 (especially in the corner portions thereof) as indicated at 46, resulting in a deterioration in the quality of the resin key top obtained. Thus, with this mold 43 and a manufacturing method using the same, it is rather difficult to form the resin key top 13 of the above-described embodiments or other embodiments of the present invention.

EXAMPLE

Next, the present invention will be described with reference to specific examples, which should not be construed restrictively.

Example 1

As the mold for molding the resin key tops (13) of polycarbonate resin for a mobile phone, the first mold (31) of hard iron for molding the front side of the resin key tops (13) and the second mold (32) of hard iron for molding the back side of the resin key tops (13) were prepared, as shown in FIGS. 5 and 6. When mated with each other, the first mold (31) and the second mold (32) define the cavity composed of the key top forming portion (34) having in the outer periphery of the lower end of the side surface thereof an outwardly protruding flange portion (39), the first runner portion (33), and the second runner portion (35). Further, the molding pin (41) of hard iron was inserted into the pin insertion hole (42) of the first mold to thereby form inside the cavity the column-like resin relief protrusion (38).

Molten polycarbonate resin was injected into the cavity through the resin injection hole (36) of the second mold (32), and after its solidification, the resin was released from the mold to obtain the molded piece. Next, the portions corresponding to the first runner portion (33) and the second runner portion (32) were removed by using a cutting die to obtain the resin key top (13) of polycarbonate resin having the arcuate clearance portion (20) in a part of the flange portion (18) thereof. This resin key top (13) had a height of 2 mm, and exhibited the flange portion (18) protruding outwardly by 0.2 to 0.5 mm from the lower end of the side surface of the resin key top (13) and having a thickness of 0.15 to 0.3 mm.

In this method of manufacturing the resin key top (13), the molding pin (41) is inserted into the cavity of the injection mold, at the position corresponding to the clearance portion (20) formed on the flange portion (18), to provide the resin relief protrusion (38), so that, solely by removing the portions corresponding to the runner portions (33, 35) by using a cutting die, the clearance portion (20) could be easily formed. Further, flow marks due to the flow of molten resin were to be observed in none of the portions of the resin key top (13) including the flange portion (18).

A polycarbonate type ink was applied by screen printing to the flange portion (18) of the resin key top (13) to form a shielding layer (not shown), and then this resin key top (13) was glued by means of ultraviolet setting type adhesive (with a thickness of 0.05 mm) to the key sheet (12) formed of translucent silicone rubber and having the accommodating portion (19) protruding by 0.5 mm at the position where it covers the chip component (16) to thereby obtain the translucent key pad (11). When combined with the substrate (17) and illuminated from the chip component (16) with an LED incorporated therein, this key pad (11) involved no light leakage through the gap between the resin key top (13) and the casing (21). Further, whether the resin key top (13) was being depressed or not, the flange portion (18) thereof did not come into contact with the chip component (16) or the accommodating portion (19) of the key sheet (12) covering the same.

Example 2

Instead of the mold used in Example 1, a mold (not shown), which differs from in a point that it had a resin relief protrusion on the first runner portion side and had no resin relief protrusion on the second runner portion side, was used to form a polycarbonate resin key top (13) in the same manner as in Embodiment 1.

As in Example 1, according to this method of manufacturing the resin key top (13), the resin key top (13) with the clearance portion (20) could be easily obtained solely by cutting off the portions corresponding to the first runner portion and the second runner portion by using the cutting die. However, some flow marks, which are seemingly attributable to the flow of molten polycarbonate resin from the first runner portion provided with the resin relief protrusion to the key top forming portion, were observed on the flange portion (18) and other portions of the resin key top (13).

Comparative Example 1

Figure 11:
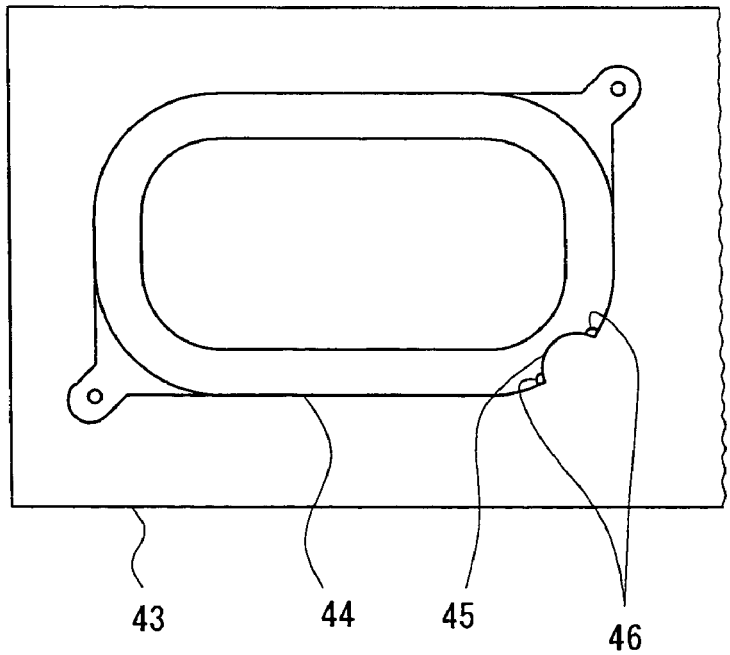
FIG. 11 is a transparent plan view of an example of a main parts of a resin key top injection mold different from that of the present invention.
Figure 12:
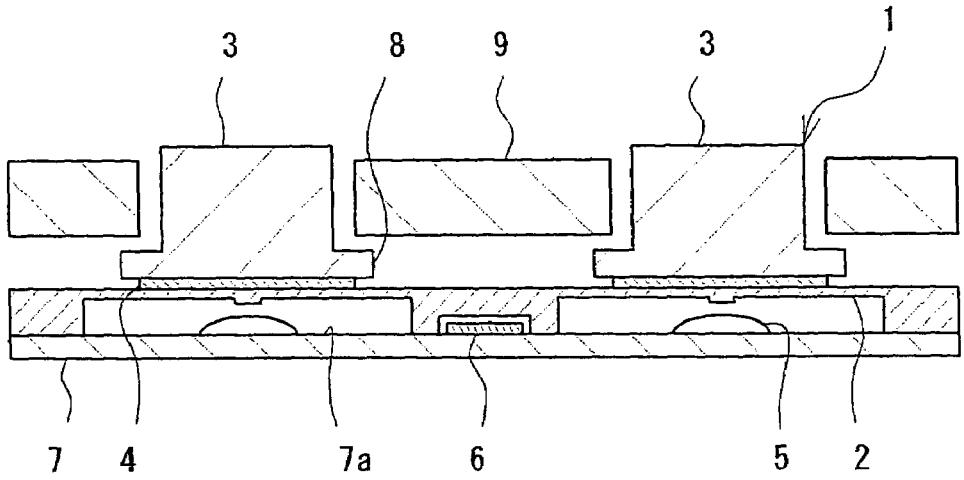
Fig.12 (Prior Art)
FIG. 12 is a longitudinal sectional view of a conventional key pad.
Figure 13:
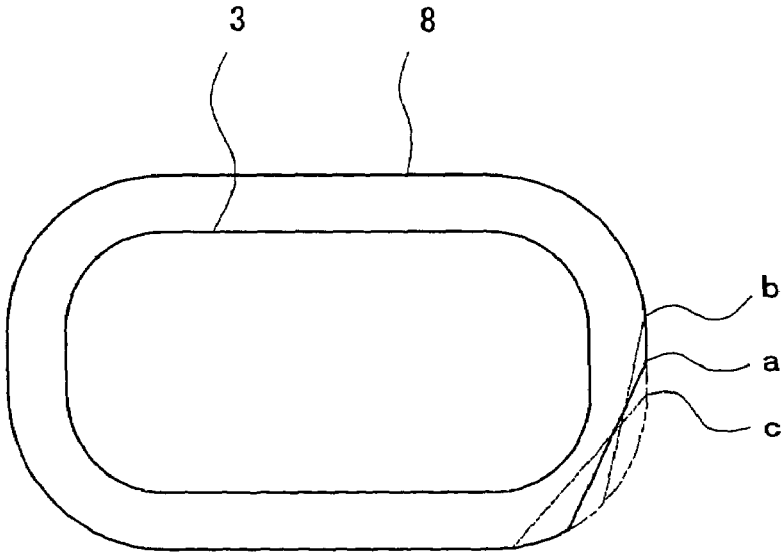
Fig.13 (Prior Art)
FIG. 13 is an explanatory drawing a plan view of a resin key top, illustrating how difficult it is to work on a resin key top after molding.

Using a mold (43) of a different construction from those of the ones used in the above example, a resin key top was prepared. As shown in FIG. 11, in the mold (43), a swollen portion (45) for forming the clearance portion was formed at a corner of the flange portion (44) where no runner portion was provided, and a resin relief protrusion was provided in none of the runner portions. In the same manner as in Example 1, a polycarbonate resin molded piece was obtained by using this mold (43).

According to this resin key top manufacturing method, the molded piece obtained through the manufacturing process involved generation of a number of air gatherings (46) on both ends of the clearance portion formed at the flange portion (44), as shown in FIG. 11.

In the key pad of the present invention and the resin key top used therein, the resin key top has a clearance portion of a configuration in conformity with the interference member, so that, even in the case of a key pad reduced in thickness and size, it is possible to prevent the resin key top from coming into contact with the interference member. Further, no light leakage occurs when illumination is effected by means of an LED or the like.

Further, in the resin key top injection mold of the present invention, there is formed in the cavity a resin relief protrusion having a molding surface swollen from the entrance of the key top forming portion for forming the resin key top and the runner portion forming a portion to be disposed of toward the key top forming portion side, is narrower than the entrance and exhibits a configuration in conformity with the outer configuration of the interference member at least the upper portion of which is situated in the displacement region of the bottom surface edge of the resin key top to be displaced upon depression. Consequently, variation in the size and configuration of the clearance portion among the resin key tops is eliminated, and it is possible to easily obtain a resin key top reduced in thickness and size and eliminating light leakage.

Further, according to the resin key top manufacturing method of the present invention, by using a predetermined mold, it is possible to easily form on the resin key top side surface, solely by the usual runner portion eliminating process, a clearance portion of a configuration in conformity with the outer configuration of the interference member at least the upper portion of which at least the upper portion is situated in the displacement region of the bottom surface edge of the resin key top to be displaced upon depression. Further, it is possible to obtain a high quality resin key top which is free from flow marks or air gathering and improved in terms of yields in a stable manner.

What is claimed is:

1. A key pad comprising:

a translucent key sheet and a plurality of resin key tops arranged on the key sheet, the key pad being provided on a substrate on which a circuit component is mounted, the circuit component protruding from a surface of the substrate, wherein a resin key top of the resin key tops has a flange portion, the flange portion outwardly protruding from a lower end side surface of the resin key top, wherein the flange portion has a clearance portion for avoiding contact with the circuit component under depression of the resin key tops, and wherein the accommodating portion of the circuit component is a leg portion floatingly supporting the resin key top mounting portion of the key sheet so as to be capable of moving toward and away from a substrate surface opposed to the key sheet back surface.

2. A resin key top injection mold comprising a key top forming portion and a runner portion communicating with the key top forming portion, the key top forming portion and the runner portion defining a cavity, wherein the resin key top injection mold further comprises a resin relief protrusion formed at an entrance that serves as a boundary between the key top forming portion and the runner portion and protruding from a surface of the cavity, the resin relief protrusion being smaller in width than the entrance and having a molding surface that is convex toward the key top forming portion, and wherein the molding surface has a configuration in conformity with an outer configuration of an interference member, the interference member having at least its upper portion situated within a displacement region where a bottom surface edge of the resin key top undergoes displacement upon depression.

3. A resin key top injection mold according to claim 2, wherein the resin relief protrusion is formed in a pin member protruding in the cavity at the entrance, and pin holes allowing detachable attachment of a plurality of pin members are formed.

4. A resin key top injection mold according to claim 2, wherein the entrance of the resin key top injection mold is wider on the key top forming portion side and narrower on the runner portion side.

5. A resin key top injection mold according to claim 2, wherein an air vent portion communicating with the runner portion is formed.

6. A resin key top manufacturing method in which a molten resin is poured into a cavity of a resin key top injection mold having a key top forming portion, the method comprising the steps of:

obtaining a molded piece by pouring a molten resin into the cavity of the resin key top injection mold, allowing the molten resin to solidify to obtain a solidified resin, and releasing the solidified resin from the resin key top injection mold, the cavity having formed therein:

at least one of an upstream side runner portion situated between a resin injection hole and the key top forming portion and a downstream side runner portion situated between the key top forming portion and an air vent portion; and a resin relief protrusion formed at an entrance that serves as a boundary between the key top forming portion and the at least one of the upstream side runner portion and the downstream side runner portion, the resin relief protrusion being smaller in width than the entrance, having a molding surface that is convex toward the key top forming portion, and having a configuration in conformity with an outer configuration of an interference member, the interference member having at least its upper portion situated within a displacement region where a bottom surface edge of the resin key top undergoes displacement upon depression; and forming the resin key top having a clearance portion formed in a side surface thereof by removing the upstream side runner portion from the molded piece, the clearance portion having a configuration in conformity with outer configuration of an interference member that has at least its upper portion situated within the displacement region where the bottom surface edge of the resin key top undergoes displacement upon depression.

7. A resin key top manufacturing method according to claim 6, wherein the resin key top injection mold is used, which has the resin relief protrusion being formed in a pin member protruding in the cavity at the entrance of the key top forming portion and the runner portion, and has pin holes allowing detachable attachment of a plurality of pin members being formed.

8. A resin key top manufacturing method according to claim 6, wherein the resin key top injection mold is used, which has the entrance of the resin key top injection mold being wider on the key top forming portion side and narrower on the runner portion side.

9. A resin key top manufacturing method according to claim 6, wherein the resin key top injection mold is used, which has the air vent portion communicating with the runner portion being formed.

10. A pushbutton switch device comprising:

a key pad having a plurality of resin key tops arranged on a translucent key sheet; and a circuit board which is arranged below the key pad and on which a circuit component serving as an illumination source is mounted, the circuit component protruding from a surface of the circuit board, the resin key tops being pressed toward the circuit board to effect an input operation with the resin key tops, wherein the circuit component is being caused to emit light to illuminate the resin key tops, wherein a resin key top of the resin key tops has a flange portion, the flange portion outwardly protruding from a lower end side surface of the resin key top, wherein the flange portion has a clearance portion for avoiding contact with the circuit component under depression of the resin key tops, the clearance portion exposing a portion of the circuit component, and wherein the accommodating portion of the circuit component is a leg portion floatingly supporting the resin key top mounting portion of the key sheet so as to be capable of moving toward and away from a substrate surface opposed to the key sheet back surface.

11. A pushbutton switch device according to claim 10, wherein the circuit component is a protrusion protruding from a general surface of a surface of the key sheet.

12. A pushbutton switch device according to claim 10, wherein the accommodating portion of the circuit component formed in the key sheet is a protrusion protruding from a general surface of a surface of the key sheet.

13. A pushbutton switch device according to claim 10, wherein the clearance portions are of a configuration in conformity with an outer configuration of the interference members.

14. A pushbutton switch device according to claim 10, wherein the clearance portions are of a configuration in which the wall thickness is reduced entirely along a height direction of the portion of he resin key top where it is formed.

15. A pushbutton switch device according to claim 10, wherein the clearance portions are of a configuration in which the wall thickness is reduced only in a lower portion along a height direction thereof.

16. A pushbutton switch device according to claim 10, wherein the flange portion is adapted to engage with the back surface of a casing.

* * * * *